US005152411A

United States Patent [19]

Pope et al.

[11] Patent Number: 5,152,411

[45] Date of Patent: Oct. 6, 1992

[54] PLASTIC AEROSOL CONTAINER HAVING A RESILIENT SHOULDER PORTION

[75] Inventors: John Pope, Wendover; Barry J. Steptoe, Stevenage, both of United Kingdom

[73] Assignee: Hoechst Celanese Plastics Limited, Watford, United Kingdom

[21] Appl. No.: 678,967

[22] PCT Filed: Jul. 17, 1990

[86] PCT No.: PCT/GB90/01088

§ 371 Date: Apr. 23, 1991

§ 102(e) Date: Apr. 23, 1991

[87] PCT Pub. No.: WO91/01928

PCT Pub. Date: Feb. 21, 1991

[30] Foreign Application Priority Data

Jul. 27, 1989 [GB] United Kingdom ..... 8917171

[51] Int. Cl.[5] ..... B65D 1/02; B65D 83/14

[52] U.S. Cl. ..... 215/1 C; 215/31; 220/609

[58] Field of Search ..... 215/1 C, 31, 3; 220/666, 609; 222/107

[56] References Cited

U.S. PATENT DOCUMENTS

| | | | |
|---|---|---|---|
| 3,179,323 | 4/1965 | Miller . | |
| 3,198,861 | 8/1965 | Marvel | 215/1 C |
| 3,199,750 | 8/1965 | Livingstone | 215/1 C X |
| 4,640,855 | 2/1987 | St. Clair | 215/1 C X |
| 4,887,730 | 12/1989 | Touzani | 220/666 X |

FOREIGN PATENT DOCUMENTS

| | | | |
|---|---|---|---|
| 0078403 | 5/1983 | European Pat. Off. . | |
| 133983 | 3/1985 | European Pat. Off. | 215/1 C |
| 1376764 | 9/1964 | France . | |
| 2470059 | 6/1981 | France | 215/31 |
| 2503665 | 10/1982 | France | 215/1 C |
| 2543923 | 10/1984 | France . | |
| 606004 | 6/1960 | Italy | 215/31 |
| 8905773 | 6/1989 | PCT Int'l Appl. . | |

*Primary Examiner*—Sue A. Weaver

*Attorney, Agent, or Firm*—Christie, Parker & Hale

[57] ABSTRACT

A plastics aerosol container includes a top portion having a neck for accommodating an aerosol valve, connected by a shoulder to the aerosol body. The shoulder includes an elbow portion of reduced thickness which acts as a hinge and serves to reduce stress caused, for instance, by transverse impacts on the container, which could otherwise damage or break the container.

7 Claims, 1 Drawing Sheet

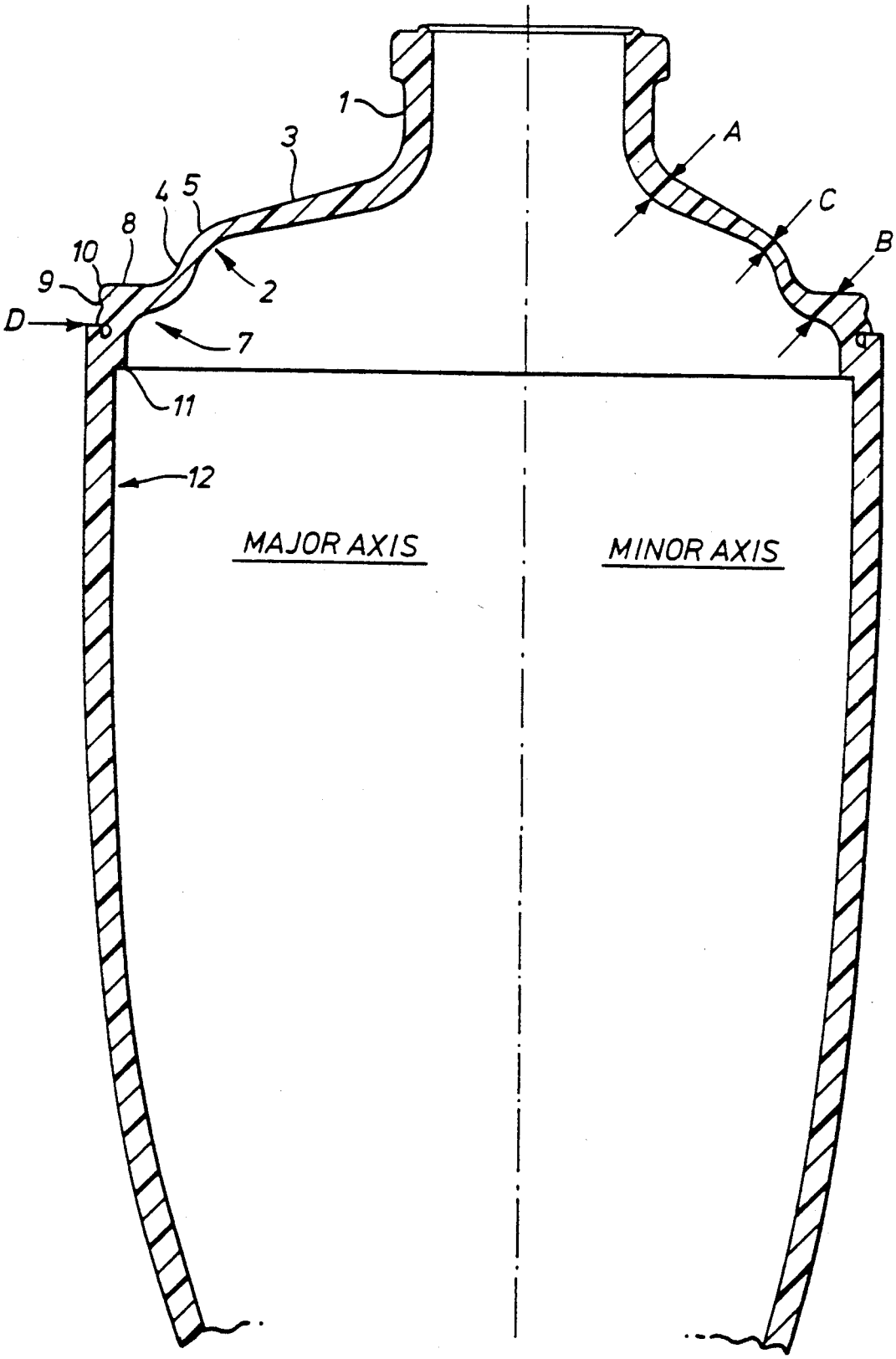
1
3
4
5
8
10
9
D
2
7
11
12
A
C
B
MAJOR AXIS
MINOR AXIS

PLASTIC AEROSOL CONTAINER HAVING A RESILIENT SHOULDER PORTION

BACKGROUND OF THE INVENTION

This invention relates to a plastics aerosol container.

Aerosol containers are mostly made of metal, e.g. aluminium or steel (tin plate). The invention relates especially to aerosol containers made of plastics, particularly thermoplastic materials, particularly of a polyacetal (acetal resin), such as acetal homopolymer or acetal copolymer e.g. polyoxymethylene with melt flow index range 9.0 to 27.00 g/10 minutes), of a thermoplastic polyester, such as polyethylene terephthalate or polybutylene terephthalate, or a thermoplastic polyolefin, such as polypropylene.

Succesful experiments have been made by the applicants with containers made of an acetal copolymer, namely that sold under the trade name Kematal, particularly Kematal M270 and Kematal M90, and Hostaform, particularly Hostaform 13031.

The invention arose in an attempt to devise a top of a plastics aerosol container that has all the necessary properties expected from such a top, in particular good lateral impact strength, which is dependent not only on the material used and its thickness (which need not be uniform) but quite significantly on its shape. Important is also creep resistance which is dependent upon the polymer type, time, temperature, internal pressure, the geometric shape and wall thickness.

Persons skilled in the art know that a number of characteristics of plastics materials, such as chemical resistance, permeation, creep and impact strength, are fundamentally different from those of metals and, in fact, differ widely even between metals, such as aluminium and steel. Experience acquired from the testing and use of metal containers is therefore practically of no help with plastics, the characteristics of which differ from each other even more widely than is the case with metals. The basic requirements as regards non-refillable plastics aerosol containers are set out in British Standard BS 5597 published in 1978, a new edition of which relating specifically to plastics aerosols, is in preparation, which may be circular or non-circular in cross-section.

SUMMARY OF THE INVENTION

According to the present invention, there is provided a top portion of a plastics container, including a neck for receiving an aerosol valve, and a shoulder portion, which shoulder portion includes a circumferential elbow of reduced thickness relative to the parts of the shoulder adjacent the elbow.

BRIEF DESCRIPTION OF THE DRAWING

The invention will now be described, by way of example only, with reference to the accompanying diagrammatic drawing which shows an axial section through one embodiment of the top portion of an aerosol container according to the invention.

DETAILED DESCRIPTION OF THE PREFERRED EMBODIMENT

Because the whole illustrated top except the "neck" (and also the associated container) is of oval cross-section the drawing shows on the left a section along the major axis and on the right a section along the minor axis.

The illustrated top comprises an open neck 1, a shoulder 2 and a rim 7.

The neck 1 is substantially tubular, has an outer flange and is adapted to accommodate an aerosol valve known per se.

The shoulder 2 has an upper portion 3 merging into the neck 1, and a lateral portion 4 merging into the upper portion 3 via a curved portion or elbow 5.

The rim 7 has an upper portion 8 merging into the lateral portion 4 of the shoulder 2, and a lateral portion 9 merging into the upper portion 8 via a curved portion 10.

As is apparent from the illustration of the shoulder 2, the thickness of the upper portion 3 and also the thickness of the lateral portion 4 decrease in the direction towards the curved portion 5.

The lateral portion 9 of the rim 7 has an annular outer portion 11. When the top is to be connected to the body 12 of the container, the outer portion 11 is inserted into the open top portion of the body 12 and the rim 7 is fixed to the body 12. In the illustrated example this has been achieved by ultrasonic welding. For that reason there is no clear borderline between the portion 11 and the body 12.

Alternatively, a container according to the invention may be constructed in one piece in which the top is integral with the body.

The drawing shows three thicknesses of of a plastic container, namely a thickness A of the upper portion 3 of the shoulder 2 and, a thickness B of the upper portion 8 and a thickness C of the curved portion 5 of the shoulder 2. The thicknesses A and B are substantially identical while the thickness C is about 40% to 60%, in the illustrated example about 50%, of the thickness A or B.

In one embodiment, thickness A may be 1.6 mm, thickness B may be 1.4 mm and thickness C may be 1.0 mm. Other thicknesses and thickness ratios may of course be used where desired. Typically, the wall of the container body may be of 1.8 mm thickness.

An impact 90° to the main axis of the container (indicated by arrow D) is an impact 90° to the wall of the container 12, but nearly parallel to the upper portion 3 of the top. As a consequence while the wall of the container 12 resiliently yields, the top of a conventional container would break because it is stiff in the direction of the impact. To avoid this, the invention provides the curved portion 5, the thickness C of which is significantly reduced with respect to the rest of the shoulder. The combination of the curvature and thickness reduction of the portion 5 lends to the top the necessary resilience which substantially equalizes the stiffness of the whole container either side of the point of impact (arrow D). The portion 5 acts as a resilient member which on impact relieves the generated stress.

We claim:

1. A top portion of a plastic container, including a neck for receiving an aerosol valve, a rim for connecting the top portion to a body portion of the container, and a shoulder portion intermediate the rim and neck, wherein the shoulder portion includes an upper portion, a lateral portion, and a circumferential elbow of reduced thickness relative to respective thicknesses of the upper and lateral portions for connecting the upper and lateral portions, a thickness of the shoulder portion increasing gradually in directions away from the elbow, and the elbow being resilient for flexing to relieve stress in response to a transverse impact on the container.

2. A container top as claimed in claim 1 wherein the thickness of the elbow is in the range of 40% to 60% that of at least portions of the upper and lateral portions of the shoulder.

3. A container top as claimed in claim 2 wherein the thickness of the elbow is substantially 50% that of the upper and lateral portions.

4. A container top as claimed in claim 1 made of a thermoplastic material.

5. A top portion as claimed in claim 1 wherein the aerosol valve has a vertical axis, and the elbow is at a distance from the vertical axis which is less than a distance from the vertical axis to the lateral portion.

6. A plastic container comprising a container body portion and a container top portion, the container top portion including a neck for receiving an aerosol valve, a rim for connecting the top portion to the body portion, and a shoulder portion intermediate the rim and neck, wherein the shoulder portion includes an upper portion, a lateral portion, and a circumferential elbow of reduced thickness relative to respective thicknesses of the upper and lateral portions for connecting the upper and lateral portions, a thickness of the shoulder portion increasing gradually in directions away from the elbow, and the elbow being resilient for flexing to relieve stress in response to a transverse impact on the container.

7. A plastic container as claimed in claim 6 wherein the aerosol valve has a vertical axis, and the elbow is at a distance from the vertical axis which is less than a distance from the vertical axis to the lateral portion.

* * * * *